US009957945B2

(12) United States Patent
Bohne et al.

(10) Patent No.: US 9,957,945 B2
(45) Date of Patent: May 1, 2018

(54) METHOD FOR CONTROLLING A CORONA IGNITION DEVICE

(71) Applicant: BorgWarner Ludwigsburg GmbH, Ludwigsburg (DE)

(72) Inventors: Steffen Bohne, Freiburg (DE); Alexander Schenk, Waiblingen (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 0 days. days.

(21) Appl. No.: 15/218,901

(22) Filed: Jul. 25, 2016

(65) Prior Publication Data

US 2017/0030323 A1 Feb. 2, 2017

(30) Foreign Application Priority Data

Jul. 27, 2015 (DE) ..... 10 2015 112 217

(51) Int. Cl.

| | |
|---|---|
| ***F02P 9/00*** | (2006.01) |
| ***F02P 23/04*** | (2006.01) |
| ***H01T 19/00*** | (2006.01) |
| ***H01T 13/44*** | (2006.01) |
| ***H01T 13/50*** | (2006.01) |
| ***F02P 3/06*** | (2006.01) |
| ***F02P 3/00*** | (2006.01) |
| *F02P 15/10* | (2006.01) |

(52) U.S. Cl.

CPC ..... *F02P 9/002* (2013.01); *F02P 3/005* (2013.01); *F02P 3/06* (2013.01); *F02P 23/04* (2013.01); *F02P 23/045* (2013.01); *H01T 13/44* (2013.01); *H01T 13/50* (2013.01); *H01T 19/00* (2013.01); *F02P 15/10* (2013.01)

(58) Field of Classification Search

CPC .... F02P 3/06; F02P 9/002; F02P 23/04; F02P 23/045; H01T 13/44; H01T 13/50; H01T 19/00

USPC ..... 701/102, 105, 106, 115; 123/143 B, 123/620–623, 598

See application file for complete search history.

(56) References Cited

U.S. PATENT DOCUMENTS

| | | | | |
|---|---|---|---|---|
| 6,282,889 | B1 * | 9/2001 | Kakuyama | F02D 41/0295 60/274 |
| 8,640,665 | B2 | 2/2014 | Trump | |
| 2001/0042371 | A1 | 11/2001 | Topfer-Hartung et al. | |
| 2004/0129241 | A1 | 7/2004 | Freen | |

(Continued)

FOREIGN PATENT DOCUMENTS

| | | | |
|---|---|---|---|
| DE | 100 04 330 | A1 | 8/2001 |
| WO | WO 2004/063560 | A1 | 7/2004 |
| WO | WO 2014/072040 | A1 | 5/2014 |

*Primary Examiner* — Hung Q Nguyen
*Assistant Examiner* — Johnny H Hoang
(74) *Attorney, Agent, or Firm* — Bose McKinney & Evans LLP

(57) ABSTRACT

Disclosed is an inventive method for controlling a corona ignition device of an internal combustion engine. A corona discharge, which ignites fuel in a combustion chamber of the engine, is generated by applying a voltage to the corona ignition device. An actual value that is characteristic of the nitrogen oxide concentration of the exhaust gas is compared with a setpoint value, and, if the actual value deviates from the setpoint value by more than a specified threshold value and the actual value is greater than the setpoint value, the voltage is reduced after the comparison.

14 Claims, 1 Drawing Sheet

(56) References Cited

U.S. PATENT DOCUMENTS

| | | | | |
|---|---|---|---|---|
| 2008/0140301 | A1* | 6/2008 | Ding | G01N 27/407<br>701/115 |
| 2008/0296174 | A1* | 12/2008 | Ding | G01N 27/4175<br>205/781 |
| 2011/0016949 | A1* | 1/2011 | Sasaki | G01N 27/4175<br>73/23.31 |
| 2015/0226141 | A1* | 8/2015 | Mac Donald | F02M 25/12<br>701/104 |
| 2015/0233280 | A1 | 8/2015 | Ernst et al. | |

* cited by examiner

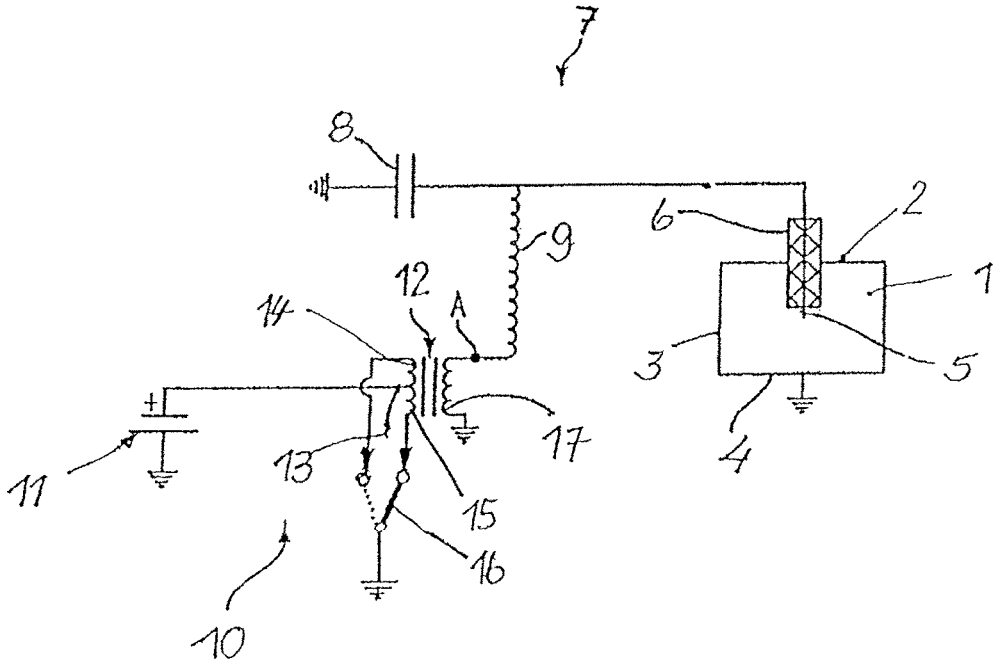
7
8
9
6
2
1
12
A
14
3
5
17
4
11
13
15
16
10

METHOD FOR CONTROLLING A CORONA IGNITION DEVICE

RELATED APPLICATIONS

This application claims priority to DE 10 2015 112 217.0, filed Jul. 27, 2015, which is hereby incorporated herein by reference in its entirety.

BACKGROUND

The present invention relates to a method for controlling a corona ignition device.

Corona ignition devices generate a corona discharge during operation, with which fuel in the combustion chamber of an engine is ignited. Corona ignition devices are thus an alternative to conventional spark plugs, which ignite fuel by means of an arc discharge.

Corona ignition devices allow a much greater ignition volume in comparison with conventional spark plugs, which in an internal combustion engine results in a much better tolerance to lean burn and better combustion statistics. Corona ignition devices therefore have the potential to allow much more efficient engine operation. Corona ignition devices not only have efficiency and fuel consumption advantages over spark plugs but also can ignite more lean mixtures and therefore significantly reduce nitrogen oxide emissions.

A corona ignition device is described, for example, in U.S. Pat. No. 8,640,665. This corona ignition device has an ignition electrode, which is accommodated in an insulator and, together with a housing radially surrounding the insulator, forms a capacitor that is part of an oscillator circuit. Said oscillator circuit is excited to resonance with a high-frequency alternating voltage of, for example, 30 kHz to 50 MHz or more. A corona discharge can be generated at the ignition electrode in this manner. The high-frequency alternating voltage is generated from a primary voltage with a voltage converter.

The corona discharge at the ignition electrode of a corona ignition device becomes greater with greater applied voltage, i.e., greater high-frequency alternating voltage and primary voltage. However, an excessive voltage must not be applied to the corona ignition device, since the corona discharge becomes an arc discharge at a critical breakdown voltage. In known methods for controlling corona ignition devices, attempts are therefore made to select a voltage that is always as close to the breakdown voltage as possible, so that the greatest possible corona discharge can be formed while a transition of the corona discharge into an arc discharge can be reliably avoided.

SUMMARY

This disclosure teaches an improvement for the control of a corona ignition device to thereby optimize engine operation.

In the context of this disclosure, it has been found that nitrogen oxide emissions can be controlled by controlling a corona ignition device such that, even under rapidly changing engine operating conditions, said emissions always remain below specified limit values, for example below 500 mg $NO_x/m^3$ according to the specifications of the German Technical Instructions on Air Quality Control (TA-Luft), e.g. for natural gas engines and stationary gas engines. If the nitrogen oxide concentration in the exhaust gas of the engine rises too much, it can be counteracted by reducing the voltage applied to the corona ignition device. This is attributed to the fact that a lower voltage results in a smaller corona discharge, which in turn causes slower combustion with a less steep rise in pressure, a lower peak pressure and a lower combustion temperature.

However, it is generally not advisable to minimise the nitrogen oxide emissions strictly, since this would limit the efficiency and power of the engine. In fact, in engine operation, there are often conflicting objectives between power and efficiency on the one hand and nitrogen oxide emissions on the other. Therefore, a compromise is typically sought between nitrogen oxide emissions on the one hand and efficiency and power on the other. In the process, increasingly strict legal requirements for nitrogen oxide emissions must be observed. This disclosure makes it possible to comply with such requirements without a complex exhaust gas post-treatment system.

A method according to this disclosure can be limited to complying with a permissible limit value for the nitrogen oxide emissions, that is, only reducing the voltage applied to the corona ignition device when a limit value is reached. As long as the nitrogen oxide concentration is below the limit value, the voltage applied to the corona ignition device can be optimized according to any other aspects. Another option is to regulate the nitrogen oxide concentration to a setpoint value. This setpoint value can for example be specified for different engine states using a characteristic map and can correspond to an optimal compromise between power, efficiency and nitrogen oxide emissions.

In a method according to this disclosure, an actual value that is characteristic of the nitrogen oxide concentration of the exhaust gas is compared with a setpoint value. If the actual value deviates from the setpoint value by more than a specified threshold value, the voltage applied to the corona ignition device is reduced after the comparison, if the actual value is greater than the setpoint value. Deviations of the actual value from the setpoint value under the specified threshold value are insignificant, and therefore it is not necessary to change the voltage. If the actual value deviates from the setpoint value by less than the specified threshold value, the voltage applied to the corona ignition device does not have to be changed.

An advantageous refinement of this disclosure provides for the voltage to be increased after the comparison between actual value and setpoint value, if the actual value is less than the setpoint value and the deviation of the actual value from the setpoint value exceeds the specified threshold value. In such an embodiment, the actual value that is characteristic of the nitrogen oxide concentration of the exhaust gas can be regulated to the setpoint value.

A value of the nitrogen oxide concentration of the exhaust gas may be provided to a control unit of the corona ignition device by means of a sensor that measures the nitrogen oxide concentration in the exhaust gas. Direct measurement of the nitrogen oxide concentration is not necessary to carry out such a method, however, since the nitrogen oxide emissions are largely determined by operating parameters of the engine. The nitrogen oxide emissions can therefore also be calculated from engine operating parameters such as the combustion temperature or the ignition delay or determined from a characteristic map.

A further advantageous refinement of this disclosure provides for a maximum value of the voltage to be specified, which is not to be exceeded, independently of the actual value that is characteristic of the nitrogen oxide concentration. In this manner, it can be ensured that the corona discharge does not change to an arc discharge. This is advantageous in particular if the actual value characteristic of the nitrogen oxide concentration is to be regulated to a setpoint value. The maximum value of the voltage applied to the corona ignition device is preferably determined by evaluating electrical characteristic variables of an oscillator circuit in the corona ignition device. For example, the impedance or the resonant frequency of the oscillator circuit can be detected and evaluated. These and other electrical variables of the oscillator circuit depend on the size of the generated corona discharge and can therefore be used to detect the formation of an excessively large corona discharge in good time and thus to determine a maximum value of the voltage at which transition into a corona discharge is still excluded. Details of how a maximum value for the voltage can be determined by evaluating electrical variables of the oscillator circuit are known from WO 2004/063560 A1, for example.

In a method according to this disclosure, the voltage applied to the corona ignition device can be changed in steps, the size of which is specified to be constant. A change in the voltage in steps of constantly equal size can be implemented with advantageously low outlay. It is however also possible to make the step size dynamic depending on the deviation of the actual value from the setpoint value. In this manner, the voltage can be adapted particularly quickly, in particular if there are large changes in the operating parameters of the engine.

With the method according to this disclosure, the corona ignition device of each individual engine cylinder can be operated with a voltage that is adapted individually for the relevant cylinder, if the actual value that is characteristic of the nitrogen oxide concentration of the exhaust gas is determined individually for each cylinder, for example by measuring the maximum combustion chamber temperature or the maximum combustion chamber pressure for each cylinder. Specifically, the nitrogen oxide emission of the relevant cylinder is substantially defined by the maximum combustion chamber pressure or the maximum combustion chamber temperature if the mixing ratio is known.

Alternatively, with the method according to this disclosure, the voltages at the corona ignition devices of all the engine cylinders can be changed jointly. This procedure is applied in particular if an individual determination of the nitrogen oxide concentration is to be omitted, for example because the nitrogen oxide concentration is measured with a sensor in the exhaust system of the engine. In this case, the voltage present at the individual corona ignition devices can for example be reduced by the same amount for all the cylinders, if the actual value is greater than the setpoint value by more than a specified threshold value. In this case, different voltages can still be present at the individual corona ignition devices, for example in order to compensate for different ageing states or degrees of contamination of the different corona ignition devices.

The voltage that is applied to the corona ignition device and is changed according to this disclosure depending on the result of a comparison between an actual value that is characteristic of the nitrogen oxide concentration of the exhaust gas and a setpoint value can be a high-frequency alternating voltage, which is used to excite an oscillator circuit containing the ignition electrode. It is also possible to regard an effective value of a primary voltage from which the high-frequency alternating voltage is generated with a voltage converter as the voltage that is applied to the corona ignition device and is changed according to this disclosure depending on the result of a comparison between an actual value that is characteristic of the nitrogen oxide concentration of the exhaust gas and a setpoint value.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein:

FIG. 1 schematically shows the structure of an ignition system for an internal combustion engine.

DETAILED DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

FIG. 1 shows a combustion chamber 1, which is delimited by walls 2, 3 and 4, which are at ground potential. An ignition electrode 5 projects into the combustion chamber 1 from above, said ignition electrode being surrounded over some of its length by an insulator 6, with which it is guided in an electrically insulated manner through the upper wall 2 into the combustion chamber 1. The ignition electrode 5 and the walls 2 to 4 of the combustion chamber 1 are part of an oscillator circuit 7, which also includes a capacitor 8 and an inductance 9. Of course, the oscillator circuit 7 can have further inductances and/or capacitors and other components that are known to a person skilled in the art as possible components of oscillator circuits.

To excite the oscillator circuit 7, a DC/AC converter is provided, which in the example shown is formed by a high-frequency generator 10, which has a DC voltage source 11 and a transformer 12, which has a central pickup 13 on its primary side, as a result of which two primary windings 14 and 15 meet at the central pickup 13. To generate a corona discharge, a primary voltage is applied to the DC/AC converter, specifically to the central pickup 13. The primary voltage can be generated from the voltage of the DC voltage source 11, for example by a pulse-width modulation process, and thus adjusted to a desired value.

The effective value of this primary voltage can be regarded as the voltage that is applied to the corona ignition device and reduced when an actual value that is characteristic of the nitrogen oxide concentration of the exhaust gas deviates by more than a specified threshold value from a setpoint value and the actual value is greater than the setpoint value. It is also possible for the primary voltage to be generated with a further voltage converter, which is supplied with a DC voltage or an alternating voltage, which can originate for example from the general electricity grid in the case of a stationary engine. If the voltage converter is not regarded as part of the corona ignition device, the high-frequency alternating voltage with which the oscillator circuit is excited can be regarded as the voltage that is applied to the corona ignition device and reduced when an actual value that is characteristic of the nitrogen oxide concentration of the exhaust gas deviates by more than a specified threshold value from a setpoint value and the actual value is greater than the setpoint value.

The ends of the primary windings 14 and 15 remote from the central pickup 13 are connected alternately to earth by means of a high-frequency selector switch 16. The switching frequency of the high-frequency selector switch 16 defines the frequency at which the series oscillator circuit 7 is excited and is variable. The secondary winding 17 of the transformer 12 supplies the series oscillator circuit 7 at point A. The high-frequency selector switch 16 is controlled with the aid of a regulating circuit such that the oscillator circuit is excited at its resonant frequency. The voltage between the tip of the ignition electrode 5 and the walls 2 to 4 at earth potential is then at its greatest.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

REFERENCE NUMBERS

1 Combustion chamber
2 Wall of combustion chamber
3 Wall of combustion chamber
4 Wall of combustion chamber, top of piston 18
5 Ignition electrode
6 Insulator
7 Oscillator circuit, series oscillator circuit
8 Capacitor
9 Inductance
10 High-frequency generator
11 DC voltage source
12 Transformer
13 Central pickup
14 Primary winding
15 Primary winding
16 High-frequency selector switch
17 Secondary winding

What is claimed is:

1. A method for controlling a corona ignition device of an internal combustion engine, the method comprising:

applying a voltage to the corona ignition device and thereby generating a corona discharge, the corona discharge igniting fuel in a combustion chamber of the engine;

determining nitrogen oxide concentration in exhaust gas of the internal combustion engine;

comparing the determined nitrogen oxide concentration with a setpoint value for nitrogen oxide concentration in the exhaust gas; and reducing the voltage applied to the corona ignition device after the comparison when the determined nitrogen oxide concentration is greater than the setpoint value by more than a first predetermined threshold amount and thereby reducing the amount of nitrogen oxide in the exhaust gas.

2. The method according to claim 1, wherein the step of determining nitrogen oxide concentration comprises measuring nitrogen oxide concentration using a sensor.

3. The method according to claim 1, wherein the step of determining nitrogen oxide concentration comprises calculating nitrogen oxide concentration from engine operating data.

4. The method according to claim 3, wherein the engine operating data includes combustion temperature or ignition delay.

5. The method according to claim 1, wherein the voltage is changed in steps as a result of the comparison of the determined nitrogen oxide concentration and the setpoint value, the size of the steps being independent of the extent of deviation of the determined nitrogen oxide concentration from the setpoint value.

6. The method according to claim 1, wherein the voltage applied to the corona ignition device is a high-frequency alternating voltage generated from a primary voltage using a voltage converter.

7. A method for controlling a corona ignition device of an internal combustion engine, the method comprising:

applying a voltage to the corona ignition device and thereby generating a corona discharge, the corona discharge igniting fuel in a combustion chamber of the engine;

determining nitrogen oxide concentration in exhaust gas of the internal combustion engine;

comparing the determined nitrogen oxide concentration with a setpoint value for nitrogen oxide concentration in the exhaust gas; and increasing the voltage applied to the corona ignition device after the comparison when the determined nitrogen oxide concentration is less than the setpoint value by more than a first predetermined threshold amount and thereby increasing the amount of nitrogen oxide in the exhaust gas.

8. The method according to claim 7, wherein the step of determining nitrogen oxide concentration comprises measuring nitrogen oxide concentration using a sensor.

9. The method according to claim 7, wherein the step of determining nitrogen oxide concentration comprises calculating nitrogen oxide concentration from engine operating data.

10. The method according to claim 9, wherein the engine operating data includes combustion temperature or ignition delay.

11. The method according to claim 7, further comprising specifying a maximum value of the voltage not to be exceeded, independently of the determined nitrogen oxide concentration.

12. The method according to claim 11, wherein the maximum value of the voltage not to be exceeded is determined dynamically by evaluating electrical characteristic variables of an oscillator circuit in the corona ignition device.

13. The method according to claim 7, wherein the voltage is changed in steps as a result of the comparison of the determined nitrogen oxide concentration and the setpoint value, the size of the steps being independent of the extent of deviation of the determined nitrogen oxide concentration from the setpoint value.

14. The method according to claim 7, wherein the voltage applied to the corona ignition device is a high-frequency alternating voltage generated from a primary voltage using a voltage converter.

* * * * *